US005199411A

United States Patent [19]

Tsao

[11] Patent Number: 5,199,411

[45] Date of Patent: Apr. 6, 1993

[54] TOY MISSILE PROJECTOR

[76] Inventor: Yung-Chi Tsao, 2F, No. 27, Lane 419, Chung-Mei Street, Taichung, Taiwan

[21] Appl. No.: 762,494

[22] Filed: Sep. 19, 1991

[51] Int. Cl.[5] ..... F41B 11/02

[52] U.S. Cl. ..... 124/67; 124/66

[58] Field of Search ..... 124/16, 26, 37, 61, 124/63-67; 401/195; 446/489

[56] References Cited

U.S. PATENT DOCUMENTS

| | | | |
|---|---|---|---|
| 1,419,308 | 6/1922 | Roe | 124/67 |
| 1,803,366 | 5/1931 | Stetson | 124/67 X |
| 2,601,033 | 6/1952 | Lawrence | 124/67 |
| 3,088,450 | 5/1963 | Clay | 124/26 |
| 3,090,151 | 5/1963 | Stewart et al. | 124/67 X |
| 4,848,307 | 7/1989 | Tsao | 124/67 X |

FOREIGN PATENT DOCUMENTS

| | | | |
|---|---|---|---|
| 1094631 | 12/1960 | Fed. Rep. of Germany | 124/68 |

*Primary Examiner*—Peter M. Cuomo
*Assistant Examiner*—John Ricci
*Attorney, Agent, or Firm*—Wenderoth, Lind & Ponack

[57] ABSTRACT

A toy missile projector comprises a tubular missile body, an outer tube and an inner tube placed within the missile body such that the outer tube is fixed to an annular groove on the missile body and maintains contact with a reset spring located in the annular groove. A piston is mounted in the lower end of the missile body, a compression spring is placed in an axial hole at the end of the piston rod, a spring and a movable pin is placed in a longitudinal key way on the outer wall of the piston body such that the movable pin is aligned with a stop hole on the missile body so that when a launching button at the stop hole is triggered, the compression spring is released and the piston rod is displaced rapidly for firing. The missile body can be formed in three sections—first, intermediate, and last outer tubes, and assembled with a guide tube and a piston rod and with a reset spring placed between the guide tube and the last outer tube. A compression spring is placed at the bottom of the piston rod, the last outer tube can be displaced within the guide tube, and the movable pin at the piston rod can be seized by the launching button so that the compression spring is compressed by the piston rod and a compressed air zone is formed in the intermediate tube to provide a large thrust force when the launching button is pushed.

16 Claims, 6 Drawing Sheets

TOY MISSILE PROJECTOR

BACKGROUND OF THE INVENTION (a) Field of the Invention

The present invention relates to a design and structure of a toy missile projector, particularly an assembly of three tubular bodies, a piston rod, a reset spring and a compression spring. The reset spring is placed between two tubular bodies, a piston rod is placed at the bottom of a tubular body and the compression spring is compressed by the piston rod so that the compression spring can be decompressed by pushing of a launching button on a tubular body, and consequently, the piston rod can displaced rapidly for purposes of firing by energy released by the compression spring.

(b) Description of the Prior Art

There are numerous designs and structures of toy guns, but most of them are for young children with emphasis on sound and lighting effect. Their value in entertainment and their functions are limited, and they can't satisfy the general public, simply because of their short range of projectile. Moreover, their structures are always very simple, consequently their service life is short, and they are hardly acceptable to the public.

SUMMARY OF THE INVENTION

The main objective of the present invention is to provide a toy missile projector designed with an appearance like a missile and making use of a piston to generate compressed air and energy released by a compression spring to project a cannonball to the longest possible range of projectile and for maximum entertainment effect.

Another objective of the present invention is to provide a toy missile projector formed by three sections of hollow tubular bodies designed with an appearance like a missile and having a reset spring to maintain the projector ready for firing after loading of the cannonball for providing a novel and wonderous effect.

Another objective of the present invention is to provide a toy missile projector with a launching button located at a selected position on its outer wall so that a pushing of the launching button can project a cannonball, and pushing down of the top tubular body can retract a piston rod to make it ready for firing. The structure permits easy loading and firing, and it is easy to operate the missile projector.

DETAILED DESCRIPTION OF THE PREFERRED EMBODIMENTS

Figure 1:
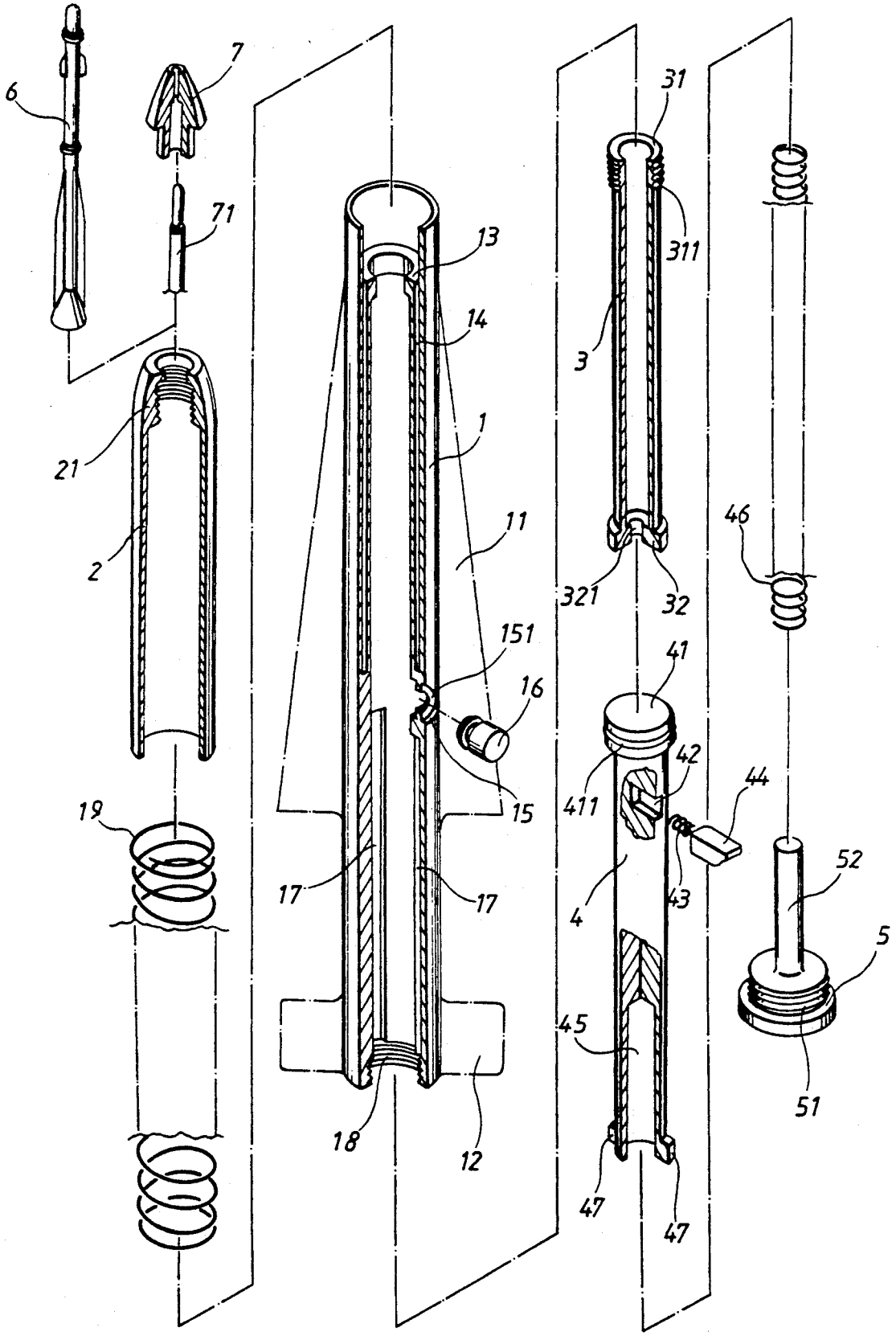
FIG. 1 is an exploded perspective view of the first embodiment of a toy missile projector according to the present invention.

As shown in FIGS. 1 to 5, the first embodiment according to the present invention comprises a missile (or projector) body (1), an outer tube (2), an inner tube (3), a piston (4), and a bottom cover (5).

The missile body (1) is in the form of a hollow tube with appropriate side wings (11) and tail wings (12) arranged to make it looks like a missile. An annular stepped portion (13) is formed along the inner wall at the upper end of the missile body (1) and an annular groove (14) of adequate depth is defined along the circumference of the annular stepped portion (13). A stop hole (15) penetrating through the tube wall is formed in the middle section of the missile body (1). A rib (151) is designed along the inner wall of the stop hole (15) for inserting and positioning of a launching button (16) for control of bullet projection. At the rear end of the missile body (1), one or more axial guiding slots (17) are designed on the inner wall, and an appropriate inner thread (18) is formed on the inner wall of the lower end.

The outer tube (2) is a hollow tubular structure having a substantially conical front tip so that it is just like a bullet. A stepped portion (21) is formed on the inner wall of the upper end, and an appropriate inner thread is formed on the stepped portion (21). The diameter of the outer tube (2) corresponds to the annular groove (14) of the missile body (1) so that the outer tube (2) is subject to a reset spring (19) located in the annular groove (14) after it is inserted into the annular groove (14).

The inner tube (3) is a hollow tubular structure. A considerably large stepped annular portion (31) is formed on the upper end of the inner tube (3) and another considerably large stepped annular portion (32) is formed on the lower end. The upper stepped annular portion (31) has an appropriate outer thread (311), and the lower stepped annular portion (32) has a relatively small hole (321) at the center. The outer thread (311) of the front stepped annular portion (31) is matches with the inner thread at the lower end of the outer tube (2), and hence the rear stepped annular portion (32) can engage with the annular stepped portion (13) of the missile body (1) to prevent disengagement of the outer tube (2) from the missile body (1) after the inner tube (3) has been inserted into the outer tube (2) through the lower end of the missile body (1).

The piston rod (4) is in the form of a rod with a relatively large stepped annular part (41) incorporated with an airtight ring (411) at an end. A longitudinal key way (42) opens through the outer wall at the upper section of the piston rod (4). A small spring (43) and a movable pin (44) are placed in the key way (42) in order. An axial hole (45) is formed in the center of the bottom end surface of the piston rod (4) for receipt of a compression spring (46). One or more blocks (47) are formed on the outer wall of the lower end of the piston rod (4) so that the blocks (47) can be displaced in a fixed direction along the guiding slots (17), and the movable pin (44) is stopped at the stop hole (15) in an energy preservation condition when the piston rod (4) is inserted from the lower end of the missile body (1). Then, by pushing the launching button (16), the movable pin (44) is pushed inwardly and the compression spring (46) is decompressed instantly to release energy to fire.

The bottom cover (5) has a stepped cover structure with an appropriate thread (51) on its outer wall. A post (52) extends from its center to hold the compression spring (46) in place and to prevent twisting of the compression spring upon compression after the bottom cover (5) is fixed to the missile body (1).

Figure 2:
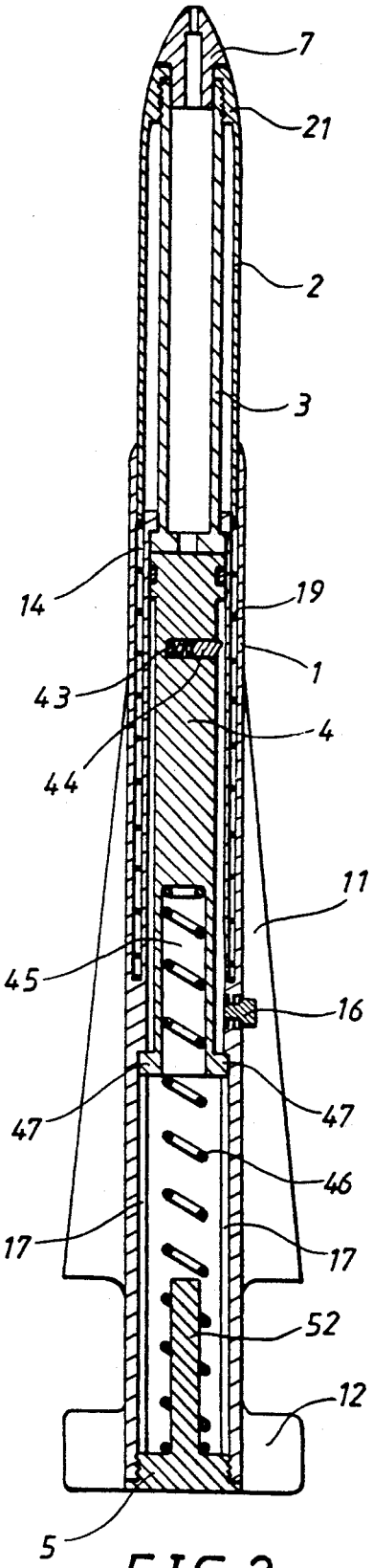
FIG. 2 is a cross-sectional view of the embodiment shown in FIG. 1.
Figure 5:
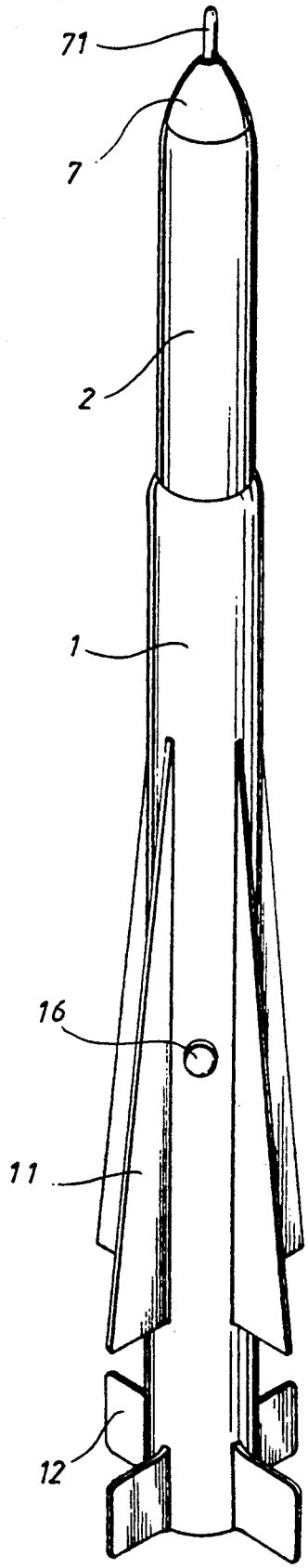
FIG. 5 is a perspective view of the first embodiment of the present invention.
Figure 4:
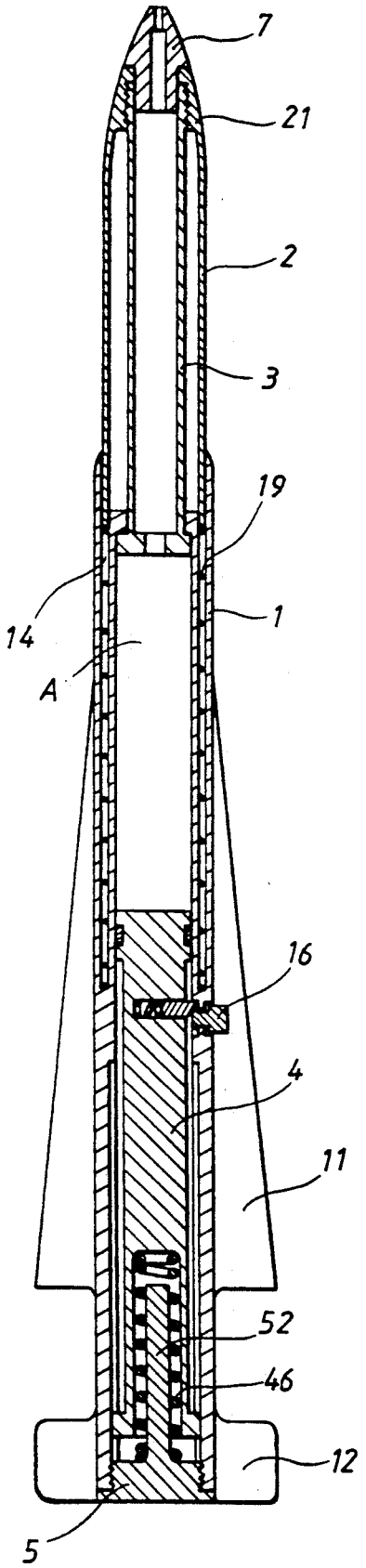
FIG. 4 is a sectional view of the first embodiment shown in FIG. 3 in a ready condition after loading of the cannonball.
Figure 3:
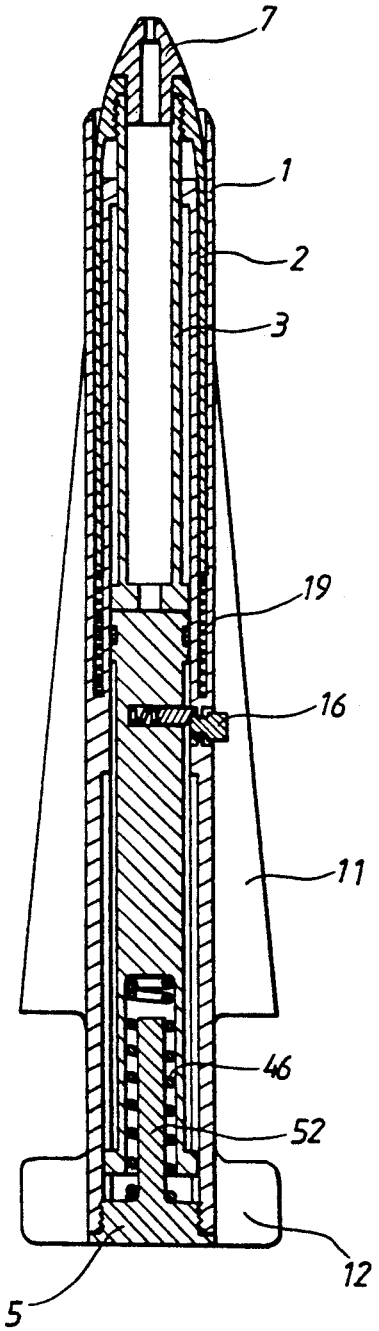
FIG. 3 illustrates the loading of a cannonball in connection with the first embodiment according to the present invention.

By assembling of the above components, a combination of the outer tube (2) and the inner tube (3) becomes a magazine mechanism. A toy cannonball (6) can be loaded in the inner tube (3) for firing. As a preparation for the firing, the outer tube (2) is pushed downwards (as shown in FIG. 3) so that the inner tube (3) forces the piston rod (4) to be displaced inwardly, the movable pin (44) of the piston rod (4) is seized at the stop hole (15) of the missile body (1), such that compression spring (46) below the piston rod (4) is compressed to preserve energy. When the outer tube 2 is released from its position in which it was used to press the piston 4 inwardly, the outwardly reset spring (19) pushes the outer tube (2), outwardly (as shown in FIG. 4). However, the retraction of the piston rod (4) in the missile body (1) forms a compressed air zone A. When the launching button (16) is pushed, the movable pin (44) is pushed inwards instantly to release the piston rod (4), the compression spring (46) extends rapidly to displace the piston rod (4) forwardly at high speed, and the compressed air zone A provides a considerably large pushing force to project the toy cannonball (6) in the inner tube (3) in a certain direction. After the projection, the assembly resumes its original condition (as shown in FIG. 2). A soft cushion may be placed at the front end of the toy cannonball (6) or the toy cannonball (6) can be made of any soft material for safety purposes. Moreover, a pen holder (7) can be fixed to the front end of the outer tube (2) so that a reservoir tube (71) can be fixed therein and the present invention can be used as a writing instrument too.

FIGS. 6 to 10 illustrate another embodiment of the present invention. This embodiment comprises mainly a three-section type hollow tube which includes a first outer tube (10), an intermediate outer tube (20), and a last outer tube (30), together with a guide tube (40), a piston rod (50) and a cover (60).

The first outer tube (10) is a hollow tubular structure with a substantially conical tip at the upper end and some appropriate wings (101) at the outer wall so that it looks like a warhead. A cannonball (102) can be placed within it for firing, or a pen holder (103) can be fixed therein for holding a reservoir tube (104) to serve as a writing instrument. An appropriate inner thread is formed on the wall of the lower end of the first outer tube (10).

The intermediate outer tube (20) is a hollow tubular structure with a small stepped portion (201) at the upper end and an appropriate outer thread for connecting to the lower end of the first outer tube (10) by engaging with the thread (105). A large stepped hole (203) is formed at the lower end of the intermediate outer tube (20), and a stop hole (204) is formed at an appropriate position on its wall. An annular rib (205) is formed on the inner wall of the stop hole (204) for installation of a launching button (206). The intermediate outer tube (20) can be designed with a plurality of appropriate wings (207) on the outer wall.

The last outer tube (30) is a hollow tubular structure with two blocks (301 and 301') on the inner wall of its upper end, and an inner thread (302) on the inner wall of its lower end. The last outer tube (30) can be designed with a plurality of wings (303) on its outer wall.

The guide tube (40) is a hollow tubular structure with a positioning hole (401) located at a selected position on the outer wall of its upper end, and two guiding slots (402 and 402') on its wall. An inner thread (403) is formed on the inner wall of the lower end. The upper end of the guide tube (40) is inserted into the large stepped hole (203) of the intermediate outer tube (20) and fixed thereto in a manner that the positioning hole (401) is aligned with the stop hole (204). The guiding slots (402 and 402') are for insertion of the blocks (301 and 301') of the last outer tube (30) for displacement of the last outer tube (30)in a fixed direction. A reset spring (70) is placed between the last outer tube (30) and the guide tube (40).

The piston rod (50) is exactly the same as that used in the first embodiment. It is positioned with a compression spring (80). It has a relatively large stepped annular part (501), an airtight ring (502), a longitudinal key way (503), a small spring (504), a movable pin (505), an axial hole (506) and one or more blocks (507, 507').

The cover (60) is a stepped circular cover with a post (601) extending from its center. An appropriate annular step (602) is formed on its stepped portion, and a threaded section (603) is formed on the inner wall of the annular step (602).

With the above described components, the first outer tube (10) and the intermediate outer tube (20) are fixed together and the upper end of the guide tube (40) is inserted into and fixed at the lower end of the intermediate outer tube (20) in such a manner that the blocks (301 and 301') of the last outer tube (30) are inserted into the guiding slots (402 and 402') of the guide tube (40), and then the piston rod (50) is placed in the last outer tube (30) in such a manner that the blocks (507, 507') of the piston rod (50) are located within the guiding slots (402 and 402') for displacement in a fixed direction. A reset spring (70) is placed between the last outer tube (30) and the guide tube (40). A compression spring (80) is placed in the axial hole (506) at the end of the piston rod (50), and the cover (60) is fixed to the end of the guide tube (40) with the inner thread (403) so that the post (601) extending from the cover (60) is at a position to receive and hold the compression spring (80). A bottom cover (90) is fixed with the inner thread (302) at the lower end of the last outer tube (30) to complete the assembly of the toy missile projector according to the present invention.

Figure 7:
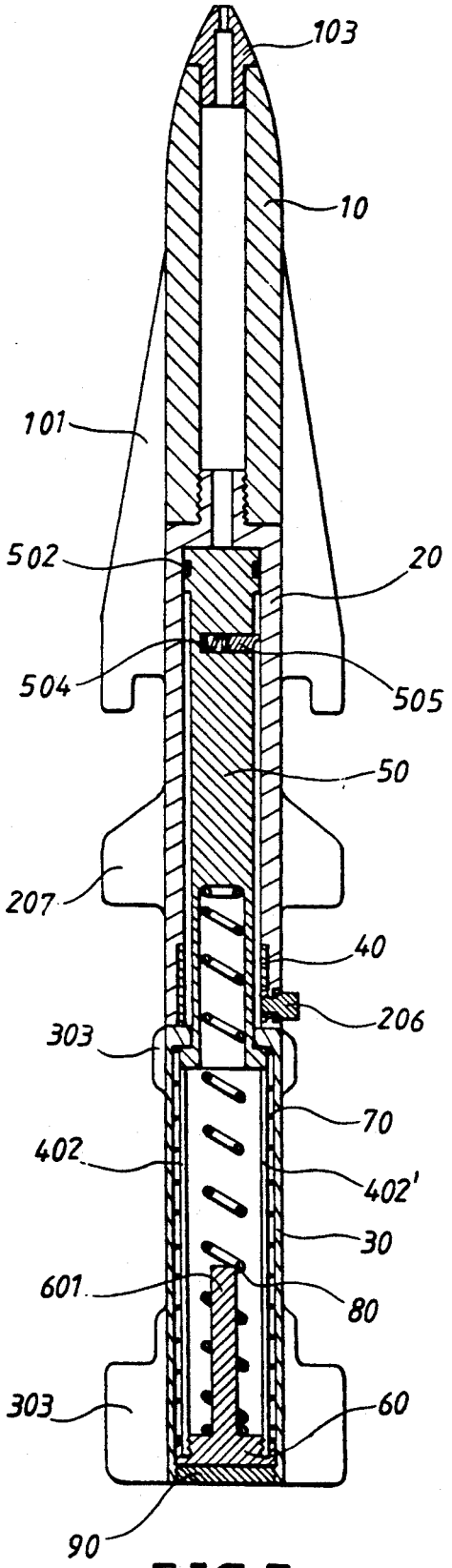
FIG. 7 is a cross-sectional view of the second embodiment shown in FIG. 6.
Figure 6:
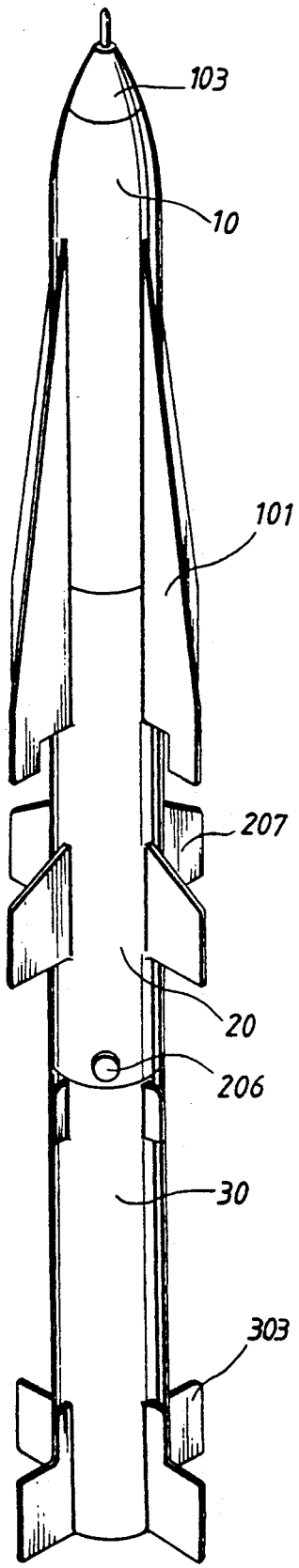
FIG. 6 is a perspective view of a second embodiment of a toy missile projector according to the present invention.
Figure 8:
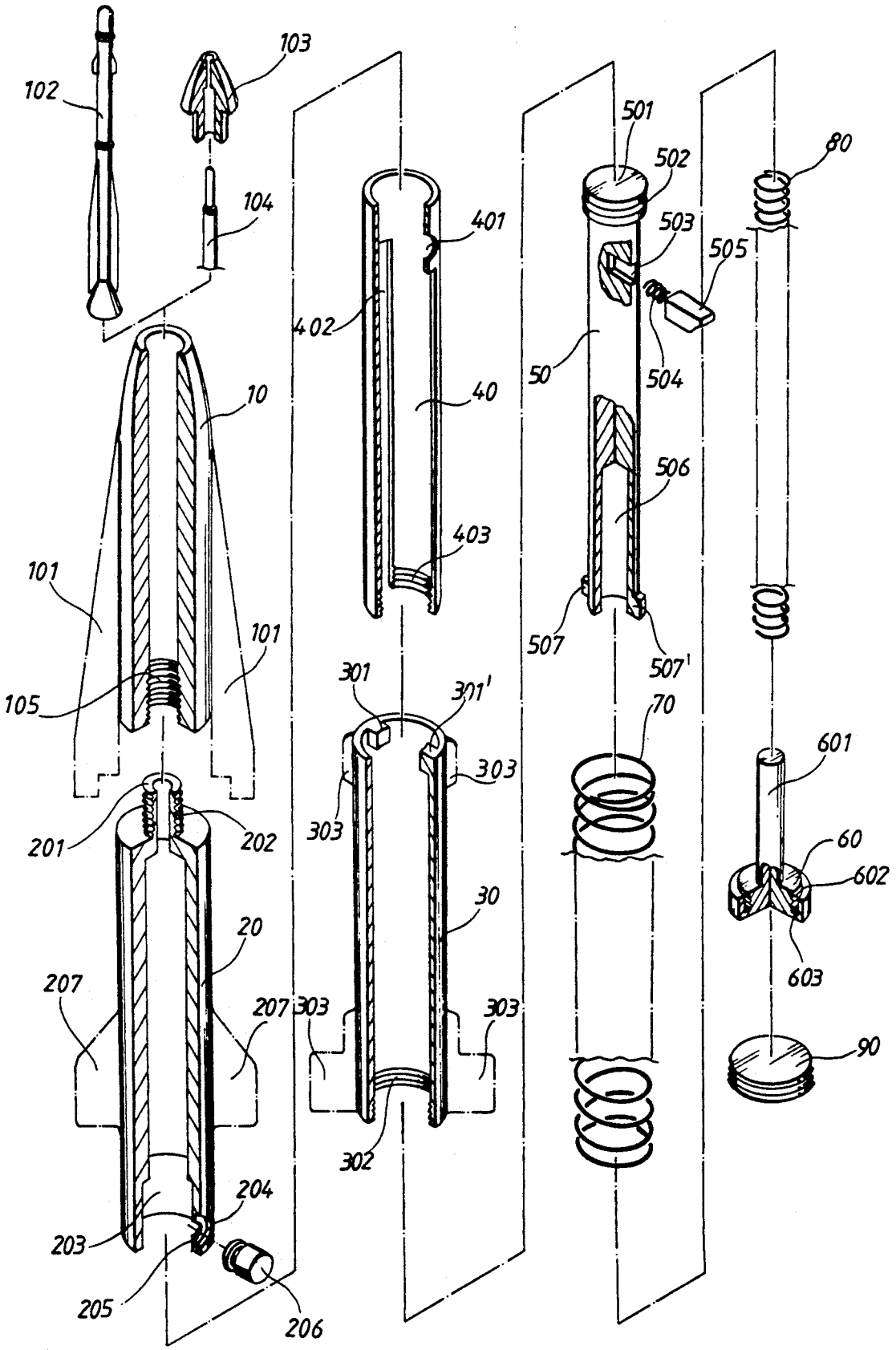
FIG. 8 is an exploded perspective view of the embodiment shown in FIG. 6.
Figure 10:
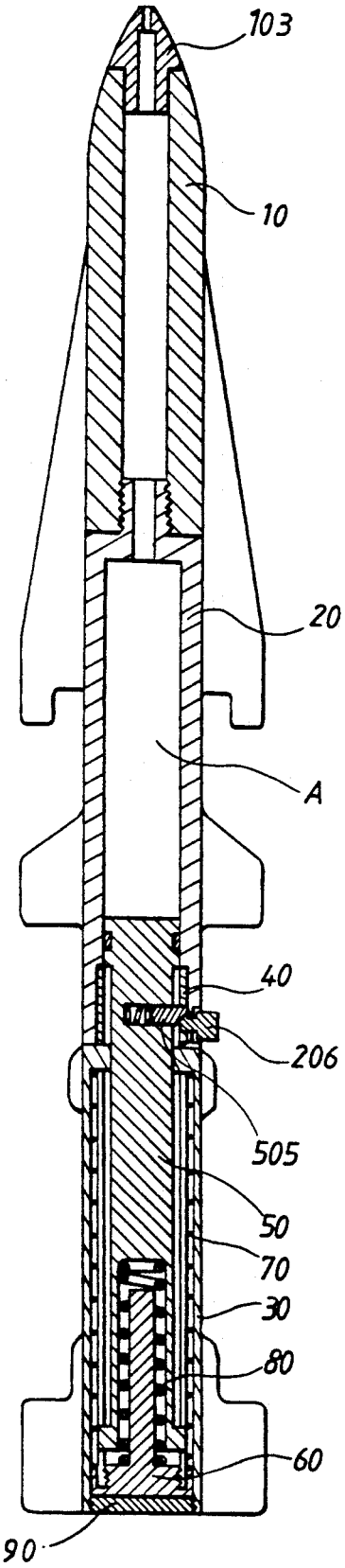
FIG. 10 is a sectional view of the second embodiment shown in FIG. 6 in a ready condition after loading of the cannonball.
Figure 9:
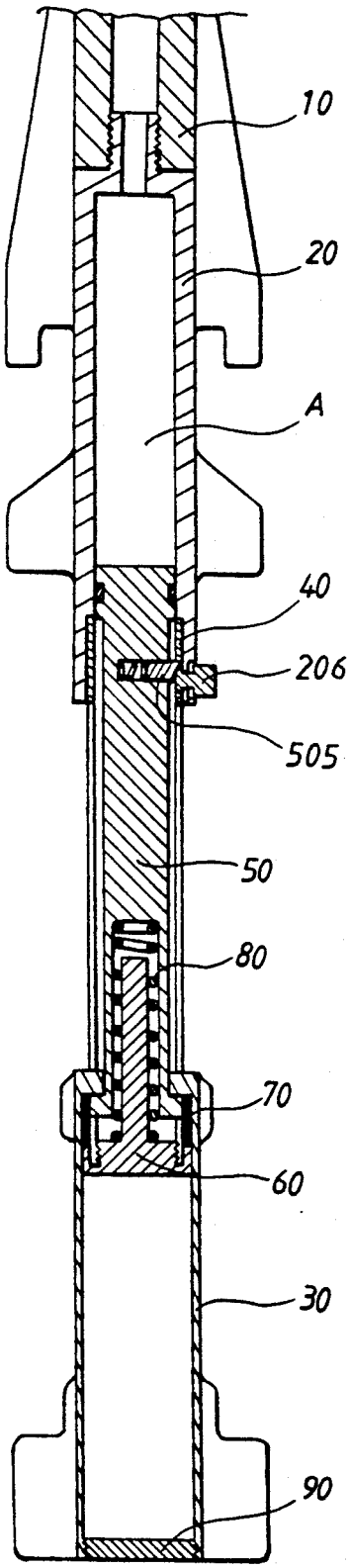
FIG. 9 illustrates the loading of a cannonball in connection with the second embodiment shown in FIG. 6.

FIG. 9 illustrates the operation of the second embodiment of the present invention. By downward pushing of the last outer tube (30) (i.e. telescopic extension of the last outer tube (30) relative to the guide tube (40), the movable pin (505) of the piston rod (50) is seized by the launching button (206) and a compressed air zone A is formed in the intermediate outer tube (20). As the reset spring (70) between the cover (60) and the last outer tube (30) has been compressed, the restoration energy released by the reset spring (70) retracts the last outer tube (30), as shown in FIG. 10, and the toy missile projector according to the present invention is ready to fire. As soon as the launching button (206) is triggered, the movable pin (505) is released, the piston rod (50) is displaced rapidly by energy released from the compression spring (80), and consequently the compressed air zone A provides a large thrust force to fire the cannonball (102) from the first outer tube (10). After such a firing process, the toy missile projector resumes its condition as shown in FIG. 7, and is ready for loading of another cannonball for firing.

I claim:

1. A toy missile projector comprising:

a hollow tubular projector body having an annular stepped portion along its inner wall at an upper end thereof, an annular groove defined about the circumference of said annular stepped portion, a stop hole formed through a middle section of the projector body, and one or more axial guiding slots formed at a lower end of said inner wall;

a reset spring disposed in said annular groove;

a hollow outer tube having an inner wall with a stepped portion at an upper end thereof, and being slidably mounted in said annular groove in contact with said reset spring;

a hollow inner tube adapted to receive a projectile therein and having a stepped annular portion at its lower end, said inner tube being fixed at its upper end to an upper end of said outer tube and being slidably mounted in said projector body for movement between a retracted position substantially within said projector body and an extended position in which said stepped annular portion at said lower end of said inner tube engages with said stepped annular portion at said upper end of said projector body, said stepped annular portion at said lower end of said inner tube having a central hole formed therein adapted to have compressed air pass therethrough for launching of the projectile;

a piston rod having a stepped annular part with an airtight ring mounted thereabout, a keyway extending in a diametral direction of said piston rod, an axially extending hole formed through the center of a bottom end surface of said piston rod, and one or more blocks formed on an outer wall at a lower end of said piston rod, said piston rod being slidably mounted in said projector body with said one or more blocks being slidably received in said one or more axial guiding slots;

a movable pin mounted in said keyway with a small spring urging said movable pin outwardly of said piston rod;

a bottom cover fixed to said lower end of said projector body; and a compression spring disposed in said axially extending hole of said piston rod and between said piston rod and said bottom cover for urging said piston rod upwardly.

2. A toy missile projector as recited in claim 1, further comprising a launching button mounted through said stop hole and adapted to displace said movable pin inwardly when said movable pin is positioned adjacent said launching button.

3. A toy missile projector as recited in claim 2, wherein said stepped annular part of said piston rod is formed at an upper end thereof.

4. A toy missile projector as claimed in claim 1, wherein said projector body has an inner thread formed at its lower end, and said bottom cover has an outer thread which engages with said inner thread at said lower end of said projector body for fixing said bottom cover to said projector body.

5. A toy missile projector as claimed in claim 4, wherein said bottom cover has a post extending from its center for holding and positioning of said compression spring.

6. A toy missile projector as claimed in claim 1, wherein said bottom cover has a post extending from its center for holding and positioning of said compression spring.

7. A toy missile projector as claimed in claim 1, wherein said projector body is formed with side wings and tail wings on its outer wall.

8. A toy missile projector comprising:

a hollow first outer tube adapted to receive a projectile therein;

a hollow intermediate outer tube having a stepped portion at its upper end fixed with a lower end of said first outer tube, a stepped hole at its lower end, a stop hole formed in a sidewall of said intermediate outer tube, and an air hole formed in an upper end of said intermediate outer tube adapted to have compressed air pass therethrough for launching of the projectile;

a hollow last outer tube having one or more blocks on its inner wall at an upper end thereof;

a hollow guide tube with a positioning hole formed through its side wall at an upper end thereof, and one or more guiding slots formed in its side wall, said guide tube having an upper end fixed in said intermediate outer tube and said guide tube being slidably mounted in said last outer tube with said one or more blocks being disposed in said one or more guiding slots;

a piston rod having a stepped annular part with an airtight ring mounted thereabout, a keyway extending in a diametral direction of said piston rod, an axially extending hole formed through the center of a bottom end surface of said piston rod, and one or more blocks formed on an outer wall at a lower end of said piston rod, said piston rod being slidably mounted in said last outer tube with said one or more blocks being slidably received in said axial guiding slots of said guide tube;

a movable pin mounted in said keyway with a small spring urging said movable pin outwardly of said piston rod;

a guide tube cover fixed to a lower end of said guide tube;

a bottom cover fixed to a lower end of said last outer tube;

a reset spring disposed in an annular space formed between said last outer tube and said guide tube and acting to urge said lower end of said guide tube toward said lower end of said last outer tube; and a compression spring disposed in said axially extending hole of said piston rod and between said piston rod and said guide tube cover for urging said piston rod upwardly.

9. A toy missile projector as recited in claim 8, further comprising a launching button mounted through said stop hole and adapted to displace said movable pin inwardly when said movable pin is positioned adjacent said launching button.

10. A toy missile projector as recited in claim 9, wherein said stepped annular part of said piston rod is formed at an upper end thereof.

11. A toy missile projector as recited in claim 10, further comprising a rib formed on an inner wall of said stop hole for receiving said launching button.

12. A toy missile projector as claimed in claim 9, wherein said first outer tube is formed with an inner thread at said lower end thereof, said intermediate outer tube has an outer thread on said stepped portion at said upper end thereof which engages with said inner thread at said lower end of said first outer tube for fixing said first outer tube and said intermediate outer tube together.

13. A toy missile projector as claimed in claim 12, wherein said cover has a post extending from its center for holding and positioning of said compression spring.

14. A toy missile projector as claimed in claim 18, wherein said cover has a post extending from its center for holding and positioning of said compression spring.

15. A toy missile projector as claimed in claim 18, wherein said last outer tube is formed with an inner thread on its inner wall at said lower end thereof, and said guide tube cover is formed a stepped circular structure with a circular step having outer threads formed thereon for fixing said guide tube cover to said guide tube.

16. A toy missile projector as claimed in claim 18, wherein said first outer tube, said intermediate outer tube and said last outer tube are formed with wings on their respective outer walls.

* * * * *